US006393777B1

(12) United States Patent
Renfrow

(10) Patent No.: US 6,393,777 B1
(45) Date of Patent: May 28, 2002

(54) WINDOW BRACKETS

(76) Inventor: Ricky L. Renfrow, 2112 Dugas Rd., Sulphur, LA (US) 70663

( * ) Notice: Subject to any disclaimer, the term of this patent is extended or adjusted under 35 U.S.C. 154(b) by 0 days.

(21) Appl. No.: 09/489,150

(22) Filed: Jan. 21, 2000

Related U.S. Application Data

(60) Provisional application No. 60/121,427, filed on Feb. 23, 1999.

(51) Int. Cl.[7] ..... E06B 3/26

(52) U.S. Cl. ..... 52/202; 52/DIG. 12; 248/475.1

(58) Field of Search ..... 52/202, DIG. 12, 52/38; 248/475.1, 466, 488

(56) References Cited

U.S. PATENT DOCUMENTS

| | | | | |
|---|---|---|---|---|
| 4,384,436 A | | 5/1983 | Green | |
| 4,394,000 A | * | 7/1983 | Kurtz | 248/466 |
| 4,457,106 A | * | 7/1984 | Forquer | 49/158 |
| 4,562,666 A | * | 1/1986 | Young, III | 49/62 |
| 5,086,604 A | | 2/1992 | Orth | |
| 5,430,982 A | * | 7/1995 | Bane | 52/202 |
| 5,603,190 A | * | 2/1997 | Sanford | 52/202 |
| 5,620,037 A | | 4/1997 | Apostolo | |
| 5,673,883 A | | 10/1997 | Figueroa, Jr. | |
| 5,918,430 A | * | 7/1999 | Rowland | 52/202 |
| 6,244,558 B1 | * | 6/2001 | Castle | 248/544 |

FOREIGN PATENT DOCUMENTS

| | | |
|---|---|---|
| FR | 2514400 | 4/1983 |
| GB | 2010948 | 7/1979 |
| IT | 629207 | 12/1961 |

* cited by examiner

*Primary Examiner*—Beth A. Stephan
*Assistant Examiner*—Naoko Slack
(74) *Attorney, Agent, or Firm*—Richard C. Litman

(57) ABSTRACT

A window guard assembly having a multiple set of permanent window brackets installed on the exterior sides of a window framing of a building or residential home at the top and bottom thereof. A top set of window brackets is arranged with mechanical fasteners as first and second inverted J-shaped mounting brackets. A bottom set of window brackets is disposed on the bottom window framing as first and second mounting brackets, and the bottom brackets are aligned with the top set of window brackets. The brackets facilitate the installation of a protective planar covering to prevent damage from flying debris during violent weather. The brackets can also facilitate substitution of a pair of decorative shutters during non-hazardous weather conditions. Each bracket may have rounded corners and include an opening in the back portion.

5 Claims, 3 Drawing Sheets

WINDOW BRACKETS

CROSS-REFERENCE TO RELATED APPLICATION

This application claims the benefit of U.S. Provisional Patent Application Serial No. 60/121,427, filed Feb. 23, 1999.

BACKGROUND OF THE INVENTION

1. Field of the Invention

The present invention relates generally to storm protection window guards. More specifically, the invention includes permanent brackets for mounting either shutters during quiescent weather or for retaining a protective covering over a window framing to prevent damage from flying debris and the like during hazardous weather.

2. Description of the Related Art

A variety of window brackets have been devised for retaining covering elements of different sorts over a window or door frame. Special ornamental fixtures have also been used in conventional window brackets to provide a certain quality or aesthetic appeal to a residential dwelling or commercial building structure.

The problem with most of the conventional window brackets rest with the enormous weight of the structures and the level of complexity required for a user to mount the respective structure. Once secured or mounted, periodic care is usually necessary for maintaining an intended aesthetic appeal of the window bracket, requiring painting or special coatings to prevent deterioration from weather effects, i.e., temperature fluctuations related to rust, corrosion, peeling, etc.

Window guards having a reduced weight and surface area for quick and easy mounting by a user whether young or old, novice or professional are significant features lacking in most conventional window guard assemblies. A simple window guard assembly which provides both a window and shutter covering without the need for special aesthetic design features or additional structural supports is lacking in most conventional window guards.

For example, U.S. Pat. No. 4,384,436 issued to Green discloses a combination hurricane shutter and security grill intended for use in conjunction with a window of a commercial or residential building. The security grill comprises metallic bars of various shapes and dimensions having a distinct ornamental design which enhance the appearance of the building. Each grill contains six brackets for retaining and covering the grill shutter board.

U.S. Pat. No. 5,086,604 issued to Orth discloses a method and apparatus for mounting storm windows which includes a retainer member having a ridge along its length and is permanently affixed to an existing window casing and a frame which has a channel for glazing and a channel for snap-accepting the ridge on the retainer member and a cover frame. The retainer member is simply an insertable snap on frame member with decorative features.

U.S. Pat. No. 5,603,190 issued to Sanford discloses a storm panel and attachment apparatus for protecting an exterior window in a structure which includes three frame members peripherally arranged as elongated frame members around the window. A plurality of mechanical fasteners are disposed uniformly and peripherally within each elongated strip to form a panel connected assembly for each window. U-shaped continuous tracks in the frame serve to retain the edges of each panel member when the panel is slid onto the elongated frame members.

U.S. Pat. No. 5,620,037 issued to Apostolo discloses a mortised removable storm shutter for covering windows comprising a top bracket having a top longitudinal track. A component is for mounting the top bracket horizontally above the window onto the exterior wall of a building, and a bottom bracket disposed horizontally below the window onto the exterior wall of the building. The top and bottom brackets have substantially C-shaped channels for receiving a panel comprising respective top and bottom I-beam shaped structures disposed on the top and bottom of the storm shutter or window covering.

U.S. Pat. No. 5,673,883 issued to Figuerora, Jr. discloses a bar device for installing a protective sheet over a window. The bar device includes a turnbuckle which is threaded on its opposite ends. Threaded rods are threaded into the turnbuckle, and a threaded bolt is secured in a manner such that the threaded rods extend perpendicular thereto. A'supporting pad is secured at the ends of the threaded rods wherein the respective pads are forced against a wall element which defines a window opening for securing the bar device within the window. Once the bar device is in place and secured a covering sheet such as plywood is secured in place by passing the threaded bolts through suitable holes disposed within the covering and securely fastening the sheet thereto.

French Pat. No. 251440 issued to Beghini et al. discloses an overglazing for a door or window leaf which has a number of fixing wedges spaced along the leaf frame with cover plates. Each overglazing clamp has a positioning wedge or block against which the edge of the overglazing is applied after a rubber seal joint has been replaced.

Great Britain Pat. No. 2010948 issued to Taylor et al. discloses a mounting structure for mounting panes of glass or translucent material in frames. A similar mounting structure is taught by Parigi (IT 629207) which discloses a mount for window frames including retaining strips which encases panes of glass or similar translucent material.

None of the above inventions and patents, taken either singly or in combination, is seen to describe the instant invention as claimed.

SUMMARY OF THE INVENTION

The window guard assembly according to the invention includes permanent window brackets that are installed at the top and bottom of the exterior sides of a window framing of a building or residential home. A top set of window brackets are mounted with mechanical fasteners as first and second inverted mounting brackets which facilitate the installation of a protective covering panel to prevent damage from flying debris during hurricanes, tropical storms, etc. A bottom set of window brackets are also disposed on the exterior sides of the window framing and centrally aligned with the top set of window brackets for facilitating alignment for decorative shutters subsequent to encountering hazardous weather conditions. When threatening weather is absent the window brackets are used as shutter supports. A set screw or the like fastener is centrally disposed in each window bracket for retaining a protective window cover or interstitial material. The window brackets being made of a coated light metallic material such as aluminum and/or a composite plastic material are lightweight and easy to install.

Accordingly, it is a principal object of the invention to provide a window guard assembly for protecting windows from flying debris during inclement weather, especially violent weather, e.g., hurricanes, thunderstorms, etc.

It is another object of the invention to provide a window guard assembly which utilizes shutters during non-hazardous weather conditions.

It is a further object of the invention to provide a window guard assembly having window brackets with reduced weight requirements made of either a light metallic material such as aluminum and/or a composite plastic material made by an injection molding process.

Still another object of the invention is to provide a window guard assembly which is quickly and easily installed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a window guard assembly for mounting window coverings and shutters to building or dwelling structures. The preferred embodiments of the present invention are depicted in FIGS. 1–5, and are generally referenced by 5 and 6 (FIG. 5).

Figure 1:
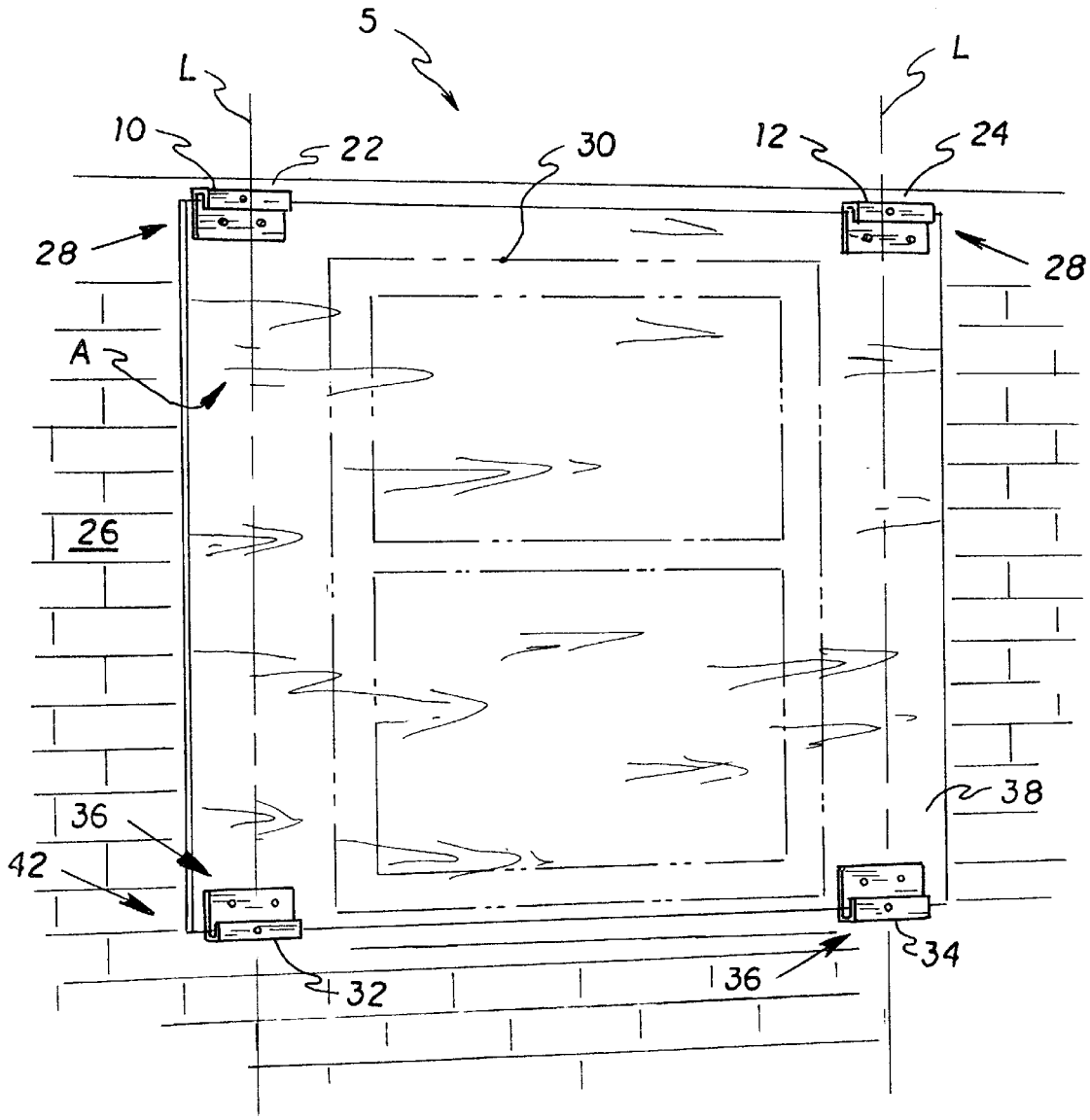
FIG. 1 is an environmental, perspective front view of the installed window guard assembly according to a first embodiment of the present invention.

As best seen in FIG. 1, the window guard assembly 5 according to a first embodiment includes a top set of a first window bracket 10 and a second window bracket 12. Brackets 10 and 12 are disposed on a first portion 22 and a second portion 24 of a building or dwelling structure 26, peripheral to a top portion 28 of a window frame 30, as independent window brackets 10, 12.

A bottom set of a first window bracket 32 and a second window bracket 34 are respectively disposed in alignment along vertical lines L with a top set of first and second window brackets 10, 12, each set being spaced apart at a predetermined distance depending on the size of the window frame 30. The bottom set of window brackets 32, 34 are disposed peripheral to a bottom portion 36 of the window frame 30 for providing an insertable slot or surface area A for an interstitial material 38 defined between the top and bottom sets of window brackets 10, 12 and 32, 34, respectively. The interstitial covering material 38 is inserted therebetween to protect the window from flying debris. The material 38 can be wood, hard plastic or metal material, so long as the material possesses the properties of being weather resistant and impervious to breakage directly related to impacts from the debris.

The top and bottom window brackets, 10, 12 and 32, 34 further have a securing element 40 for setting and securing the interstitial material 38 thereto. The element 40 is preferably a mechanical fastener such as a set screw or the like, for removably fastening the covering material 38 to form a single integrated window guard assembly 5. The bottom set of window brackets 32, 34 are also disposed on a portion of the building or dwelling structure 26 at a location 42 as single and independent first and second window brackets 32, 34, respectively.

Figure 2:
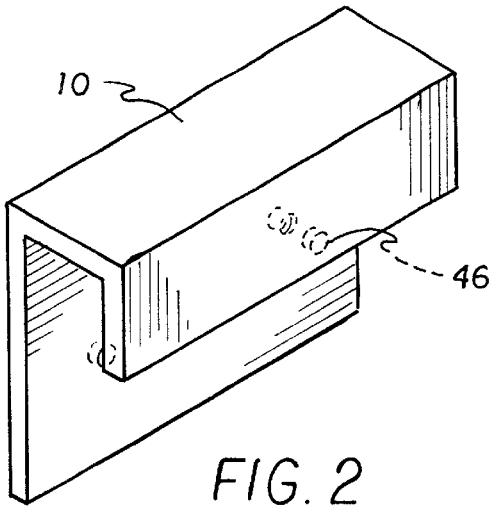
FIG. 2 is a perspective front view of an inverted J-shaped window bracket of the first embodiment showing the apertures for fasteners in shadow according to the present invention.
Figure 3:
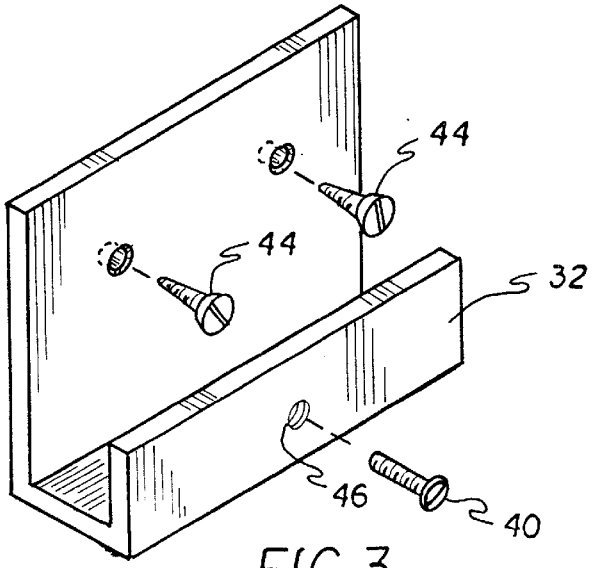
FIG. 3 is an exploded perspective view of a bottom window bracket of the first embodiment according to the present invention, illustrating the addition of mechanical fasteners.

As diagrammatically illustrated in FIGS. 2 and 3, brackets 10 and 32, respectively, of the window guard assembly 5 are shown as an exemplary embodiment only, made up of two mechanical fasteners 44 such as screw fasteners for permanently affixing each bracket 10, 32 to the exterior of the building or dwelling 26. A threaded aperture 46 is defined within each respective bracket 10, 32, etc. for receiving a set screw 40 or the like for securing an interstitial window covering material 38 therebetween as a single panel.

Figure 4:
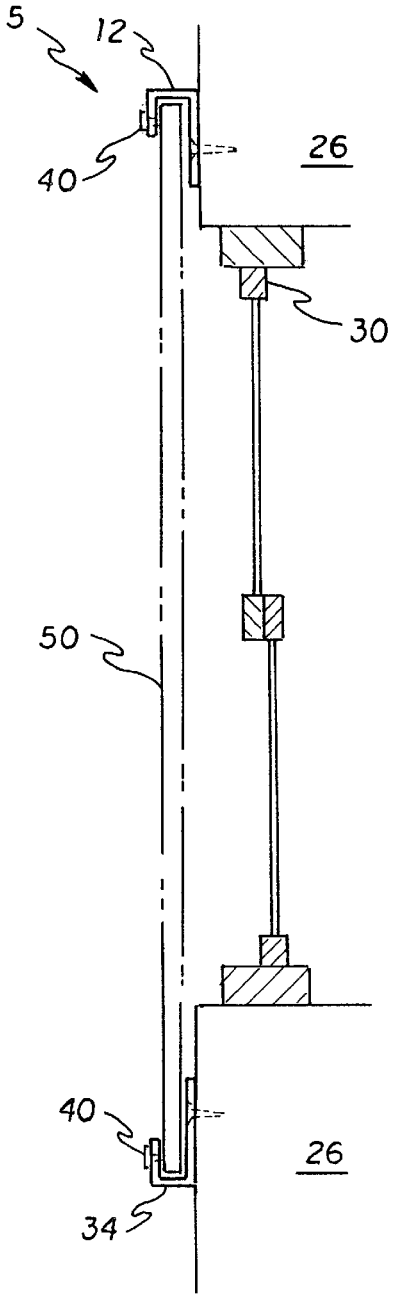
FIG. 4 is an environmental, partially sectional, side elevational view of the window guard assembly illustrating a shutter arrangement as a second embodiment of the present invention utilized during quiescent weather conditions.
Figure 5:
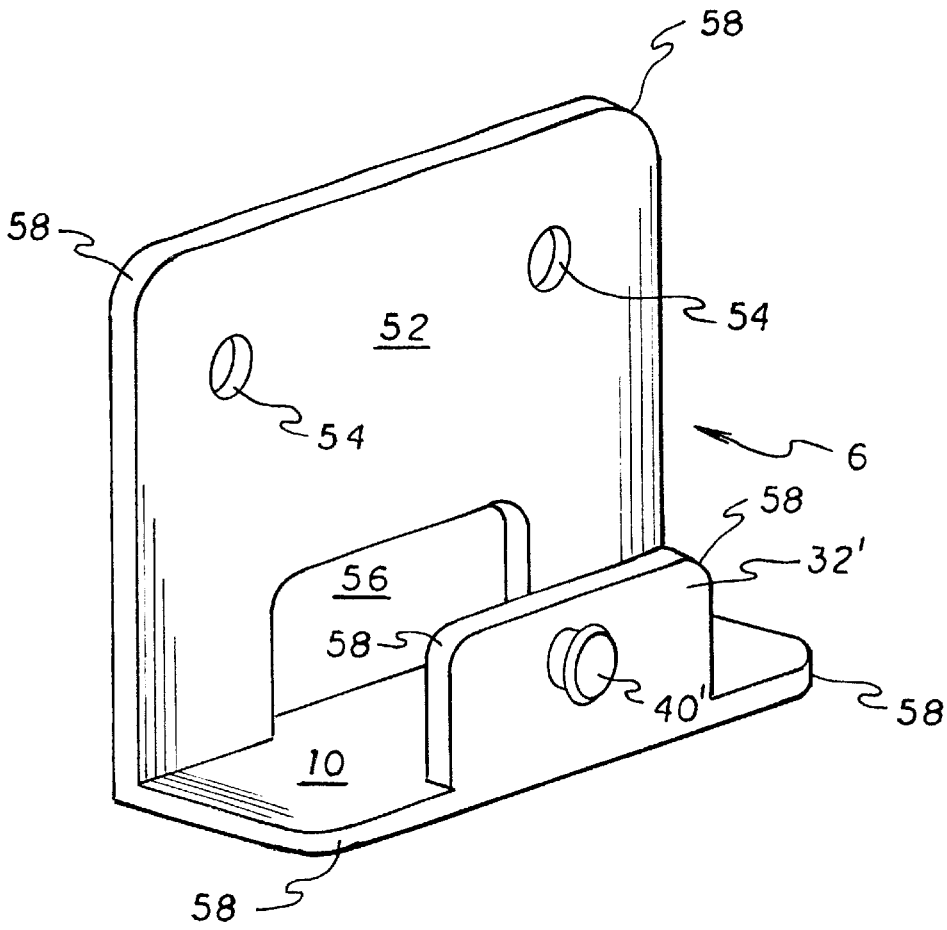
FIG. 5 is a front perspective view of a modified inverted J-shaped window bracket with round corner edges and having an enlarged aperture in its back portion and a reduced front portion according to a third embodiment of the present invention.

As shown in FIG. 4, the window guard assembly according to a second embodiment is illustrated. The interstitial material is shown as a single panel of material 50 to form a shutter on either side of the window frame 30 during non-hazardous weather conditions. The shutters 50 can be made according to any desired ornamental scheme to add a certain aesthetic appeal to the building or dwelling.

The window bracket 6 according to a third embodiment is diagrammatically illustrated in FIG. 5. As shown therein a modified J-shaped window bracket 32' includes a base portion 10' for securing an interstitial material 50 (FIG. 4), and an enlarged opening 56 in a back portion 52. This particular embodiment is produced by an injection molding process and includes curved corners 58 in addition to the enlarged opening 56 which reduces the amount of material and the corresponding cost in manufacturing. An optional spring loaded fastener 40' is also shown for releasably retaining an interstitial material 50 (as recited above) therebetween. Apertures 54 can be threaded for securing each window bracket 6 used for a wall, building or dwelling 26.

It is to be understood that the present invention is not limited to the embodiments described above, but encompasses any and all embodiments within the scope of the following claims.

I claim:

1. A window guard assembly for protecting an exterior window in a building structure, said assembly comprising:

a top first bracket and a top second bracket spaced apart from said top first bracket, said top first bracket and said top second bracket being disposed proximate a top portion of the exterior window, each said top bracket having an inverted J-shaped cross-section to define an insertable slot;

a bottom first bracket vertically aligned with said top first bracket and a bottom second bracket vertically aligned with said top second bracket and spaced apart from said bottom first bracket, said bottom first bracket and said bottom second bracket being disposed proximate a bottom portion of the exterior window, each said bottom bracket having a J-shaped cross-section to define an insertable slot;

a planar protective panel inserted between each said top bracket and each said bottom bracket for covering the window;

means for permanently mounting each said top bracket and each said bottom bracket to the building structure; and means for removably securing said protective panel between each said top bracket and each said bottom bracket, said securing means being disposed on each said top bracket and each said bottom bracket;

whereby, the protective panel is employed during hazardous weather and replaced by shutters during quiescent weather.

2. The window guard assembly according to claim 1, wherein said mounting means includes mechanical fasteners.

3. The window guard assembly according to claim 1, wherein said removable securing means includes a set screw in each said top bracket and each said bottom bracket.

4. The window guard assembly according to claim 1, wherein said protective panel is made of a weather impervious material.

5. The window guard assembly according to claim 1, wherein said weather impervious material is selected from the group consisting of wood, plastic and metal.

* * * * *